US008196571B2

(12) United States Patent
Jenson

(10) Patent No.: US 8,196,571 B2
(45) Date of Patent: Jun. 12, 2012

(54) APPARATUS, SYSTEM, AND METHOD FOR LAUNCHING A GRANULAR SUBSTANCE

(76) Inventor: Martin W. Jenson, Smithfield, UT (US)

( * ) Notice: Subject to any disclaimer, the term of this patent is extended or adjusted under 35 U.S.C. 154(b) by 727 days.

(21) Appl. No.: 11/684,508

(22) Filed: Mar. 9, 2007

(65) Prior Publication Data

US 2010/0288255 A1 Nov. 18, 2010

(51) Int. Cl.
*F41B 11/00* (2006.01)

(52) U.S. Cl. ..... 124/73; 124/49; 239/379

(58) Field of Classification Search ..... 239/654, 239/655, 397, 375–379; 124/69, 41.1, 45, 124/49, 73; 451/102; 42/1.08; 89/14.1–14.5
See application file for complete search history.

(56) References Cited

U.S. PATENT DOCUMENTS

| | | | | | |
|---|---|---|---|---|---|
| 165,276 | A | * | 7/1875 | Van Patten | 239/654 |
| 346,650 | A | * | 8/1886 | Freeman | 239/654 |
| 600,547 | A | * | 3/1898 | Mazzanovich | 222/633 |
| 1,755,329 | A | * | 4/1930 | McCormack | 239/654 |
| 2,084,682 | A | * | 6/1937 | Guenot | 169/15 |
| 2,315,853 | A | | 4/1943 | Hodgson | |
| 2,574,578 | A | * | 11/1951 | Martinet | 43/124 |
| 2,887,274 | A | * | 5/1959 | Swenson | 239/371 |
| 2,964,302 | A | * | 12/1960 | Tombu | 366/11 |
| 3,123,003 | A | | 3/1964 | Lange, Jr. et al. | |
| 3,163,963 | A | * | 1/1965 | Caron | 451/90 |
| 3,338,167 | A | | 8/1967 | Jungermann et al. | |
| 3,425,601 | A | * | 2/1969 | Fry | 406/130 |
| 3,442,454 | A | * | 5/1969 | Strossner et al. | 406/144 |
| 3,463,047 | A | | 8/1969 | Germershausen | |
| 3,789,891 | A | * | 2/1974 | Bosch | 141/331 |
| 3,793,778 | A | * | 2/1974 | Price | 451/99 |
| 3,819,157 | A | * | 6/1974 | Markfelt | 366/101 |
| 3,892,360 | A | * | 7/1975 | Schlottmann et al. | 239/345 |
| 4,089,441 | A | * | 5/1978 | Cole et al. | 222/631 |
| 4,109,579 | A | | 8/1978 | Carter | |
| 4,288,036 | A | * | 9/1981 | Jubinville | 239/345 |
| 4,498,395 | A | | 2/1985 | Kock et al. | |
| 4,502,640 | A | * | 3/1985 | Nonis | 239/346 |
| 4,628,644 | A | * | 12/1986 | Somers | 451/90 |
| 4,656,092 | A | | 4/1987 | Haman et al. | |
| 4,850,278 | A | | 7/1989 | Dinkha et al. | |
| 4,939,996 | A | | 7/1990 | Dinkha et al. | |
| 5,039,017 | A | * | 8/1991 | Howe | 239/346 |
| 5,158,455 | A | * | 10/1992 | Bailey | 433/88 |
| 5,190,217 | A | * | 3/1993 | Black et al. | 239/154 |
| 5,232,425 | A | * | 8/1993 | Miller et al. | 482/121 |
| 5,257,615 | A | * | 11/1993 | Jones | 124/56 |
| 5,348,543 | A | * | 9/1994 | Talley | 604/192 |
| 5,353,712 | A | | 10/1994 | Olson | |
| 5,390,439 | A | * | 2/1995 | Kilian et al. | 43/55 |
| 5,442,860 | A | * | 8/1995 | Palmer | 42/120 |

(Continued)

*Primary Examiner* — Michael Carone
*Assistant Examiner* — Jonathan C Weber
(74) *Attorney, Agent, or Firm* — Kunzler Needham Massey & Thorpe

(57) ABSTRACT

An apparatus, system, and method are disclosed for launching a granular substance. The method may include providing a granular substance, an air gun, a compressed air source, an insertion tube, a passage, a loading chamber, a recess, a cover, and a fastening assembly. The method may further include inserting the granular substance into the recess and dispensing the granular substance from the recess into the loading chamber. The method continues with releasing the stored, compressed air in the air gun. The compressed air moves into the insertion tube, through the passage, through the loading chamber disposed within the passage, and finally launches the granular substance from an outlet of the passage.

19 Claims, 4 Drawing Sheets

U.S. PATENT DOCUMENTS

| | | | | |
|---|---|---|---|---|
| 5,448,951 | A | 9/1995 | Olson | |
| 5,936,190 | A | 8/1999 | Buzick | |
| 6,223,658 | B1 | 5/2001 | Rosa et al. | |
| 6,343,897 | B1 * | 2/2002 | Cutler | 406/143 |
| 6,345,936 | B2 * | 2/2002 | Pfeiffer | 406/197 |
| 6,691,892 | B2 * | 2/2004 | Odessa | 222/1 |
| 6,726,125 | B1 * | 4/2004 | Nonis et al. | 239/375 |
| 6,793,563 | B2 * | 9/2004 | Daniel | 451/90 |
| 7,065,944 | B1 * | 6/2006 | Steele | 56/1 |
| 2006/0027223 | A1 * | 2/2006 | Vasel et al. | 124/57 |

* cited by examiner

APPARATUS, SYSTEM, AND METHOD FOR LAUNCHING A GRANULAR SUBSTANCE

BACKGROUND OF THE INVENTION

1. Field of the Invention

This invention relates to devices and techniques for launching projectiles and more particularly relates to the launching of granular substances from an air-powered gun.

2. Description of the Related Art

Myriad devices and techniques are known for the launching of projectiles and have a long and well-known history. The advancement and modification of projectile launchers continues unabated. Common motivations for the use of projectile launchers include protection, elimination of pests, hunting, and recreation. The development of projectile launching devices spans the entirety of recorded history and includes recognizable examples like spear-throwers, slings, bows, ballistae, catapults, trebuchets, and a plethora of gun powder devices. One unique class of projectile launching device may be classified as an 'air gun'. Air guns, or air-powered launching devices, were first likely developed in the late years B.C. and included the simple, yet effective blow gun. The blow gun uses human lung power to generate the pressure necessary to launch a projectile, such as a dart. One famous example of the pervasiveness of air gun utility throughout history is the pump action air rifle used by the Lewis and Clark expedition of the early $19^{th}$ century.

Air guns of all types utilize the accumulated energy of compressed air as the impetus for accelerating a projectile. Quickly releasing the compressed air behind a projectile creates a difference in air pressure between the compressed air on one side of the projectile and the ambient air pressure on another side of the projectile, causing the projectile to move in the direction of lowest pressure, launching the projectile. The greater the difference between the compressed air pressure and the ambient air pressure, the more kinetic energy is transferred to the projectile.

Development in air gun technology may be considered to encompass three principal challenges. Firstly, there are challenges pertaining to the creation of air pressures higher than those provided by lung power. Increases in generated air pressure come initially with the incorporation of air bladders (similar to forge bellows), then pump action pressure accumulators, and recently prepackaged containers of pressurized gas. One source of prepackaged pressurized gas is the carbon dioxide ($CO_2$) cartridge common to many types of air-powered devices. In one instance, the cartridge may be clipped into the butt of an air gun where an actuator draws off pressure from the cartridge to propel a projectile. In another instance, a separate auxiliary tank of $CO_2$ is used to charge a cylinder coupled to the air-powered device.

Secondly, there are challenges relating to the production techniques and materials used for the manufacture of air guns. Superior manufacturing techniques facilitate precise tolerances among air gun components, allowing for greater projectile launching accuracy. Material components produced from metallic and polymer components, coupled with advancements in valve technology, permit greater pressures to be contained and precisely released, facilitating more power and accuracy. Thirdly, there are challenges of projectile design encompassing accuracy, quality, and function. Some examples of projectiles presently manufactured for use in air-powered guns include pellets, BBs, darts, and paintballs.

The progression of air gun development from handmade tubes using lung power to precisely manufactured implements utilizing state of the art projectiles is testament to the continuing resiliency and expanding applicability of the air gun concept. And though many advancements in the field of air gun technology have improved and/or expanded the air gun's function, most have come with a corresponding cost of ownership: chiefly the expense incurred by expending projectiles.

SUMMARY OF THE INVENTION

From the foregoing discussion, it should be apparent that a need exists for an apparatus, system, and method that mitigates the expense of air gun projectiles. Beneficially, such an apparatus, system, and method would permit the use of a common granular substance to be launched from an air gun.

The present invention has been developed in response to the present state of the art, and in particular, in response to the problems and needs in the art that have not yet been fully solved by currently available technology. Accordingly, the present invention has been developed to provide an apparatus, system, and method for launching a granular substance that overcome many or all of the above-discussed shortcomings in the art.

An apparatus is disclosed for launching a granular substance. The apparatus may comprise a passage, a loading chamber, and a recess. The recess may be configured to receive the granular substance and dispense the granular substance into the loading chamber. The loading chamber may be formed from a declivity of the passage such that an approximately consistent portion of the granular substance is dispensed into the declivity.

The loading chamber may include a screen positioned within the passage such that the granular substance is restricted from moving in the direction of the air gun by way of the passage. The screen may be adjustable such that an amount of the granular substance dispensed into the loading chamber may be adjusted. The recess may use a gravity feed and/or a mechanical feed for the granular substance. The recess may include a portal that may be manipulated to restrict entry of the granular substance into the loading chamber. The apparatus may further include a removable cover to receive the granular substance into the recess. The cover, when closed, may substantially seal the recess.

A system is disclosed for launching a granular substance. The system includes an air gun that discharges air from a barrel and an apparatus fastened to the barrel. The apparatus includes an insertion tube and a passage forming a contiguous passageway. The passageway channels air discharged from the barrel of the air gun. The apparatus further includes a loading chamber, a recess, and a fastening assembly. The air gun and the apparatus may also be manufactured together as a single device.

A method is disclosed for launching a granular substance. The method includes providing an air gun, an insertion tube, a passage, a loading chamber, a recess, and a fastening assembly. The method further includes inserting the granular substance into the recess, dispensing the granular substance into the loading chamber, and releasing the compressed air stored in the air gun to launch the granular substance.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
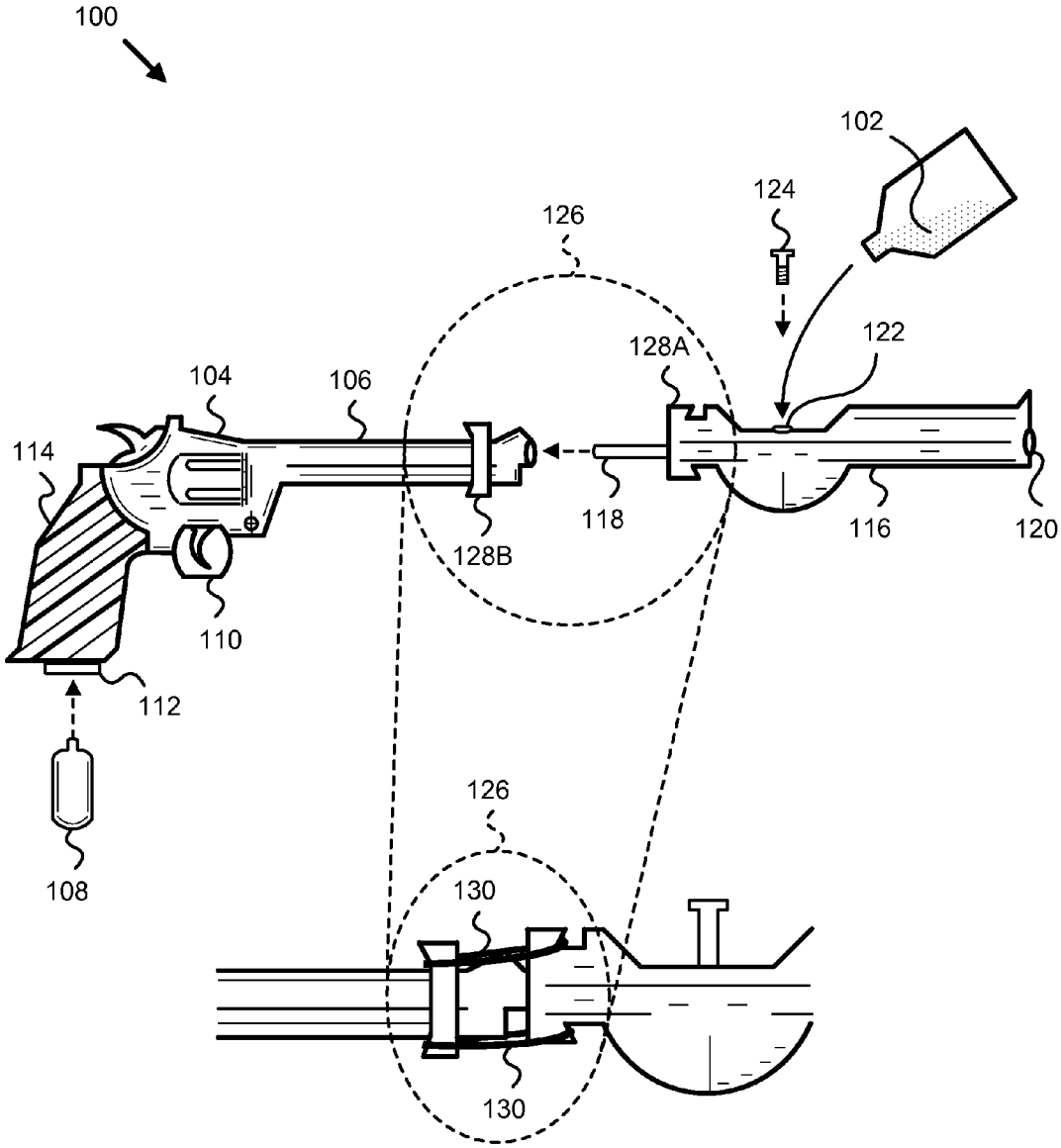
FIG. 1 is an illustration depicting one embodiment of a system to launch a granular substance in accordance with the present invention.

FIG. 1 is an illustration depicting one embodiment of a system 100 to launch a granular substance 102 in accordance with the present invention. Myriad configurations and types of granular substances 102 are contemplated within the scope of the invention. For example, observation suggests that ordinary table salt 102 may function well within the system 100 as a means for eliminating pests such as insects. Granular substances 102 such as rock salt, sugar, and coarse sand may be suitable as granular substances 102, as well.

The system 100 includes an air gun 104 comprising a barrel 106 configured to discharge compressed air from the barrel 106. The air gun 104 may comprise any type of air gun 104 configure to discharge compressed air including a hand-held air pistol 104 and a pneumatic rifle 104. The air gun 104 includes a compressed air source 108 such as a $CO_2$ cartridge 108, a refillable $CO_2$ tank 108, and a manually rechargeable cylinder 108 comprising a pump and valve assembly. The air gun 104 may further include a trigger 110 configured to discharge the compressed air 108. In one embodiment the air gun 104 may comprise an inlet 112 configured to receive the compressed air source 108 and a stock 114 configured to hold the compressed air source 108.

The system 100 further comprises an apparatus 116 for launching a granular substance 102. In one embodiment the apparatus 116 comprises an auxiliary attachment 116 for the air gun 104 that may be coupled to and uncoupled from the air gun 104 as required. In an alternate embodiment the apparatus 116 may be integrally formed with the air gun 104 during the manufacture of the air gun 104, or the apparatus 116 may comprise a permanent modification to an existing air gun 104.

The apparatus 116 may comprise a plurality of interchangeable insertion tubes 118, each interchangeable insertion tube 118 corresponding to a specific caliber of a bore of a barrel 106 of an air gun 104. In one embodiment each interchangeable insertion tube 118 may screw into the apparatus 116. In an alternate embodiment each interchangeable insertion tube 118 may be attached to the apparatus 116 by means of a catch or other device. The insertion tube 118 is configured to insert into the barrel 106 of the air gun 104 and direct discharged air from the barrel 106 of the air gun 104 into a passage (see FIG. 3, element 304) coupled to the insertion tube 118. The passage and the insertion tube 118 form a substantially sealed and contiguous passageway configured to channel discharged air from the barrel 106 through the apparatus 116 and out an apparatus outlet 120. In an alternate embodiment the insertion tube 118 and the passage comprise a single component. In other alternate embodiments the length of the apparatus 116 comprising the insertion tube 118 and the passage may be varied to adjust for requirements of accuracy, power, and range.

The insertion tube 118 may be of variable length, the length for a particular application being determined by the specifications of a particular air gun 104, such as barrel length and compressed air velocity within the barrel 106. One of skill in the art may determine a functional length for the insertion tube 118 by simple experimentation and the disclosures contained herein. In one embodiment, the insertion tube 118 diameter is sized to correspond to a variety of air guns 104. For example, the insertion tube 118 may correspond to a .177 caliber air gun. Alternatively, the insertion tube 118 may be sized to fit a .22 caliber, .25 caliber, or larger air gun 104 caliber. In an alternative embodiment, the insertion tube 118 may include an adapter (not shown) or the like to facilitate attaching the apparatus 116 to differently sized air guns 104.

The apparatus 116 may further include a loading chamber (see FIG. 3, element 306) disposed within the passage configured to contain an amount of the granular substance 102. The loading chamber may be filled with the granular substance 102 from a recess (see FIG. 3, element 310) connected to the loading chamber. The recess may be configured to receive the granular substance 102 through an inlet 122. The recess configured to receive the granular substance 102 may also comprise a cover 124, the cover configured to allow the granular substance 102 into the recess. The cover 124 may be further configured to substantially seal the recess. The cover 124 may comprise a cap 124, lid 124, screw 124, or other cover device 124.

The system 100 may further comprise a fastening assembly 126 configured to conjoin the apparatus 116 to the air gun 104. In one embodiment the fastening assembly 126 may include a fastener 128A attached to the apparatus 116, a fastener 128B attached to the air gun 104, and at least one elastic band 130 mechanically attached to both fasteners such that the apparatus 116 and the air gun 104 are coupled together. One example shown in FIG. 1 of a fastener 128B attached to the air gun 104, comprises a mechanical feature 128B anchored to the air gun 104. The fastener 128B may be anchored to the air gun 104 by clamping, screwing, adhering, and/or affixing by some other method known in the art. In an alternate embodiment, the fastener 128B is an original feature of the air gun 104. For example, the fastener 128B may comprise a raised protrusion 128B on the barrel 106 suitable for attachment of the elastic band 130. In a further embodiment the apparatus 116 and the air gun 104 are integrally coupled, such as by welding. The air gun 104 and the apparatus 116 may also be manufactured together as a single device.

Figure 2:
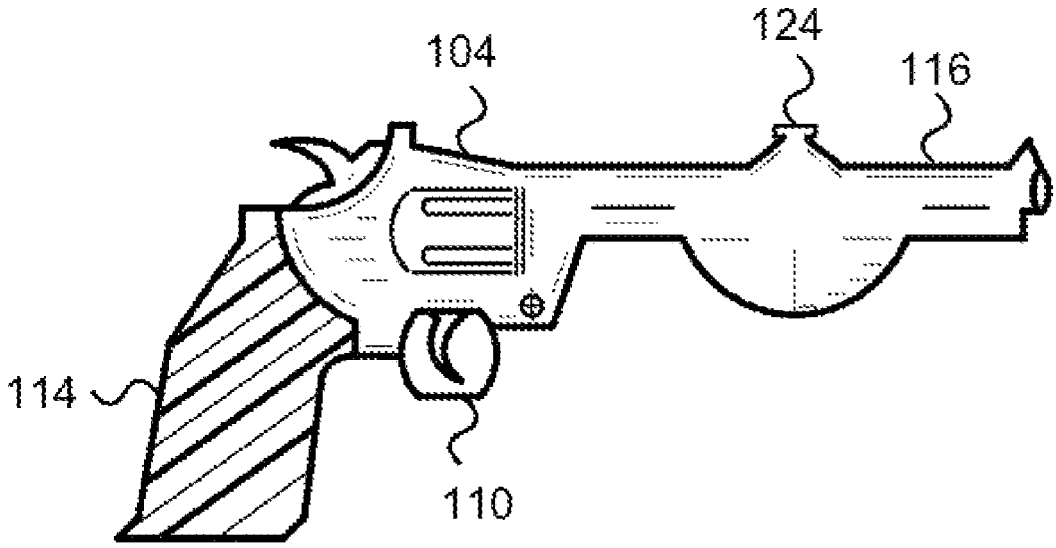
FIG. 2 is an illustration depicting an integrally formed air gun and apparatus 200 to launch a granular substance in accordance with the present invention.

FIG. 2 is an illustration depicting an integrally formed air gun 104 and apparatus 116 to launch a granular substance 102 in accordance with the present invention. The air gun 104 and apparatus 116 may be manufactured as a single granular substance 102 launching device. The granular substance 102 launching device may be in the form of a pistol, rifle, or other air gun 104 configuration. In one embodiment, the granular substance 102 launching device may comprise a devise featuring a dual mode where one mode permits the launching of granular substances 102 and another mode permits the launching of traditional air gun 104 projectiles.

Figure 3:
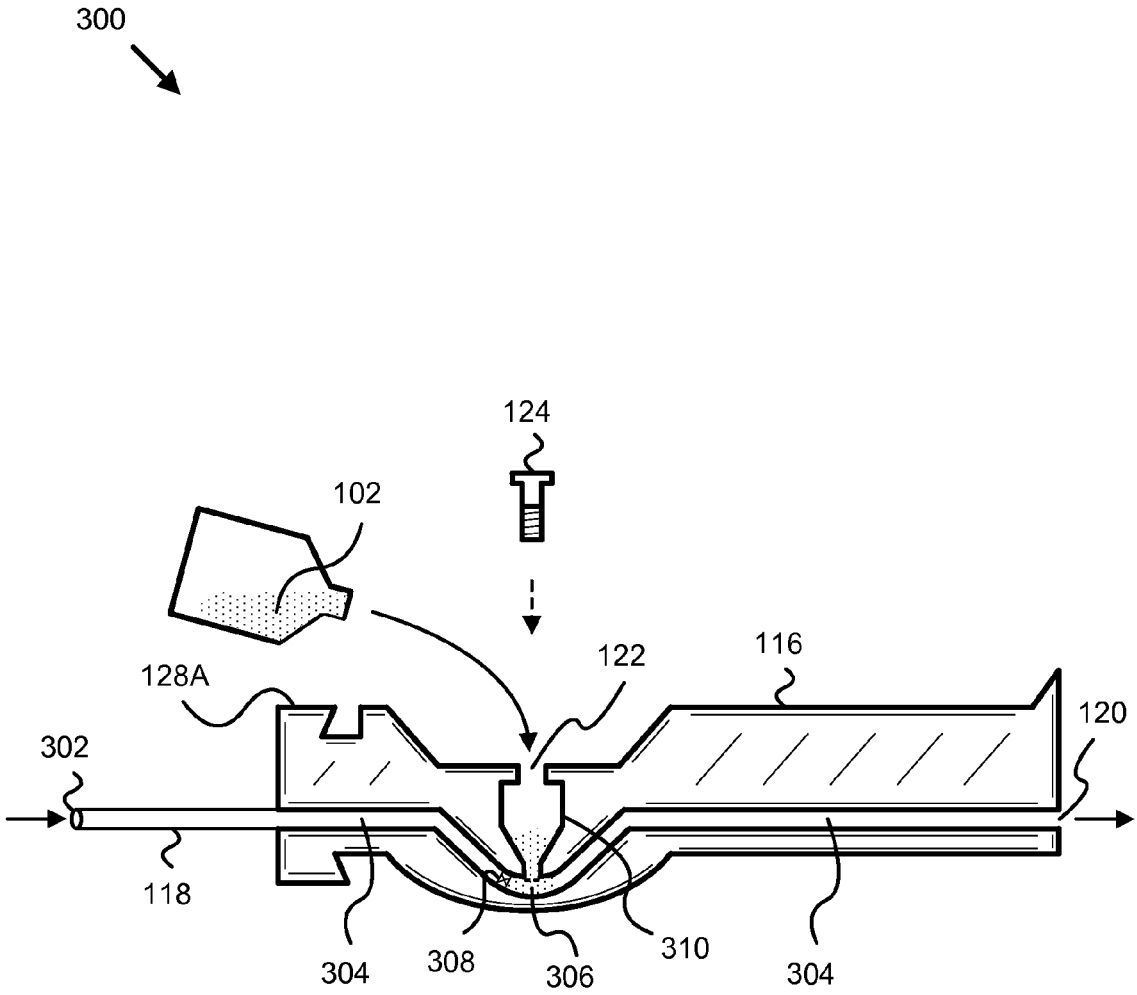
FIG. 3 is an illustration depicting one embodiment of a cross-section of an apparatus to launch a granular substance in accordance with the present invention.

FIG. 3 is an illustration depicting one embodiment of a cross-section 300 of an apparatus 116 to launch a granular substance 102 in accordance with the present invention. The cross-section 300 comprises a compressed air inlet 302 configured to receive and channel a charge of compressed air into a passage 304. The passage 304 is configured to further channel the charge of compressed air through the device 116, directing the compressed air charge ultimately to the apparatus outlet 120 where the compressed air and accompanying granular substance 102 are discharged. In one embodiment the passage 304 comprises a declivity 306 configured as a loading chamber 306. The loading chamber 306 holds the granular substance 102 'round' until a charge of compressed air accelerates the granular substance 102 down the passage 304 and out the apparatus outlet 120. In an alternate embodiment the passage 304 may comprise a substantially linear passage 304.

The cross-section 300 further comprises a loading chamber 306 disposed within a region 306 of the passage 304. The loading chamber 306 may be configured to receive and contain an amount of the granular substance 102. The loading chamber 306 may be formed from a declivity 306 of the passage 304 such that an approximately consistent portion of the granular substance 102 is dispensed into and confined with a region of the declivity 306. In an embodiment where there may be a continuous feed of granulated substance 102 into the loading chamber 306 the action of gravity on the granular substance 102 within the declivity 306 determines an approximately fixed portion of granulated substance 102 for each filling of the loading chamber 306. The loading chamber 306 may further comprise a screen 308 positioned within the passage 304 such that the granular substance 102 may be restricted from moving in the direction of the air gun 104 by way of the passage 304. The screen 308 may comprise an adjustable screen 308 such that an amount of the granular substance 102 dispensed into the loading chamber 306 may be adjusted.

The cross-section 300 includes a recess 310 connected to the loading chamber 306. The recess 310 is configured to receive the granular substance 102 through an inlet 122 and dispense the granular substance 102 into the loading chamber 306. The recess 310 may dispense the granulated substance 102 by means of a gravity feed and/or mechanical feed method. In one embodiment the recess 310 comprises a mechanism whereby granulated substances 102 retained in the recess 310 are restricted from entering the passage 304. The recess 310 may further comprise a cover 124 configured to allow a granulated substance 102 into the recess 310 and/or substantially seal the recess. In an alternate embodiment the recess 310 may comprise a detachable component 310, such as a hopper 310, permitting rapid reloading of the apparatus 116.

The schematic flow chart diagrams that follow are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 4:
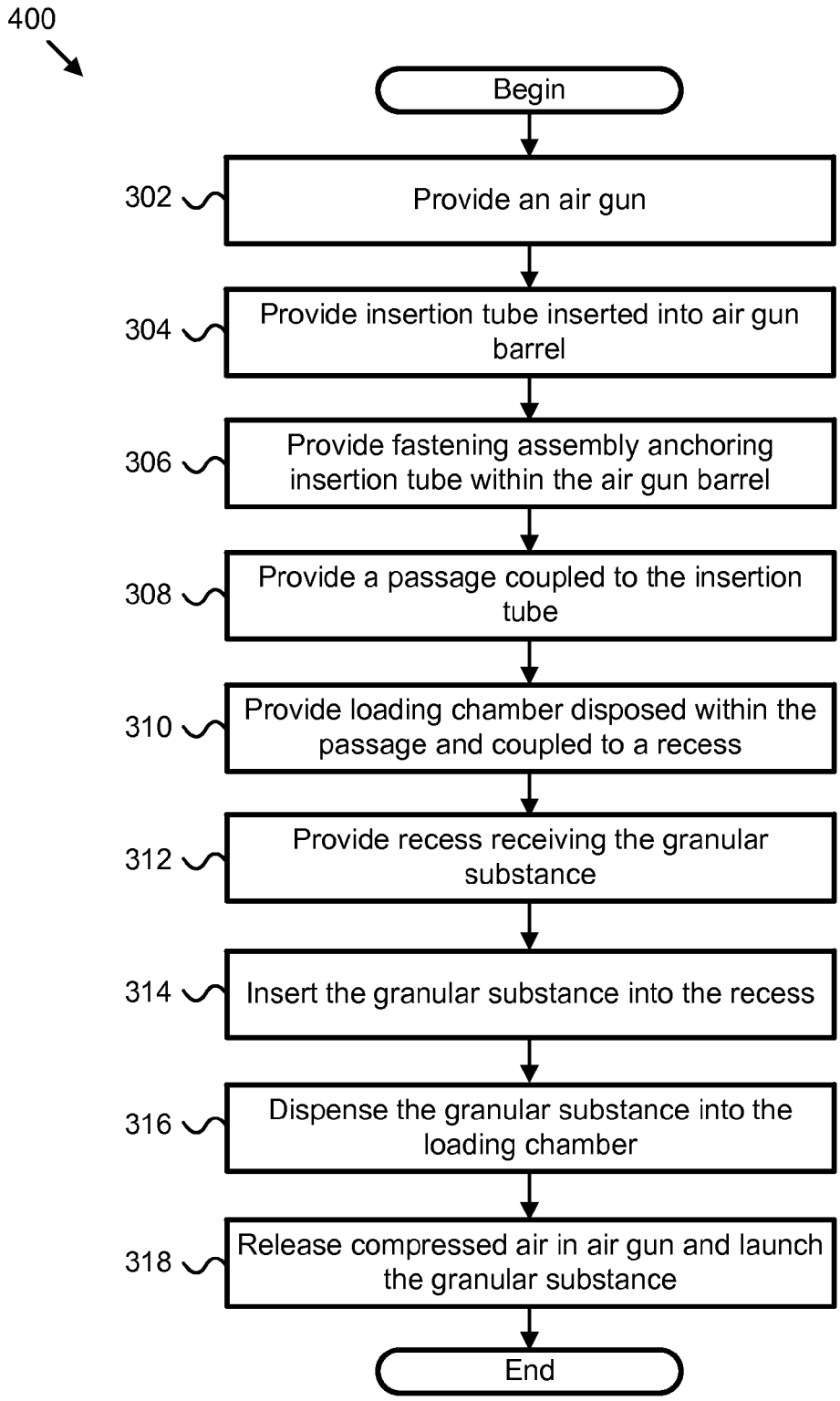
FIG. 4 is a schematic flow chart diagram illustrating one embodiment of a method to launch a granular substance in accordance with the present invention.

FIG. 4 is a schematic flow chart diagram illustrating one embodiment of a method 400 to launch a granular substance 102 in accordance with the present invention. The method 400 comprises providing an air gun 104, providing an insertion tube 118 inserted into the air gun 104 barrel 106, and providing a fastening assembly 126 anchoring the insertion tube 118 within the barrel 106. The method 400 continues with providing a passage 304 coupled to the insertion tube 118, such that the insertion tube 118 and the passage 304 comprise a contiguous passageway. The method 400 further includes providing a loading chamber 306 disposed within the passage 304 and coupling the loading chamber 306 to a recess 310. Insert the granular substance 102 into the recess 310, dispense the granular substance 102 from the recess 310 into the loading chamber 306, and finally release the compressed air 108 launching the granular substance 102.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for launching a granular substance, the apparatus comprising:

a continuous passage configured to channel bursts of air discharged from an air gun to the apparatus outlet the passage having a substantially consistent diameter;

the air gun comprising a gun barrel through which the bursts of air discharge;

a loading chamber disposed within the passage, the loading chamber configured to contain and temporarily store an amount of a granular substance during a time period between discharges of bursts of air from the air gun, the base of the loading chamber formed from a declivity of the passage;

a recess connected to the loading chamber and located externally to the passage, the recess configured to receive the granular substance, temporarily store the granular substance by allowing the granular substance to rest on walls of the recess and on the granular substance in the loading chamber, and dispense the granular substance into the loading chamber after a discharge of a burst of air from the air gun; and a top of the recess remaining substantially level with a top of the barrel of the air gun.

2. The apparatus of claim 1, wherein a region of the passage comprises the loading chamber, the loading chamber formed from a declivity of the passage such that an approximately consistent portion of the granular substance is dispensed into the declivity, rests upon a floor of the declivity, and is confined within the declivity until the passage receives a discharge of air, from the air gun, the declivity comprising a bow shape.

3. The apparatus of claim 1, wherein the loading chamber disposed within the passage comprises a screen, the screen positioned within the passage such that the granular substance is restricted from moving in the direction of the air gun by way of the passage.

4. The apparatus of claim 3, wherein the screen positioned within the passage comprises an adjustable screen such that an amount of the granular substance dispensed into the loading chamber may be adjusted.

5. The apparatus of claim 1, wherein a hopper is contained within the recess, wherein the granular substance enters the hopper and rests upon walls of the hopper, the walls of the recess, and on the granular substance in the loading chamber, until the passage receives an air discharge from the air gun.

6. The apparatus of claim 1, wherein the recess connected to the loading chamber comprises a pure gravity feed.

7. The apparatus of claim 1, wherein the recess connected to the loading chamber comprises a mechanical feed.

8. The apparatus of claim 1, wherein the recess connected to the loading chamber comprises a portal, such that entry of the granular substance into the loading chamber from the recess may be restricted.

9. The apparatus of claim 1, wherein the recess configured to receive the granular substance comprises a cover, the cover configured to allow the granular substance into the recess, and the cover configured to substantially seal the recess.

10. The apparatus of claim 1, wherein the recess configured to receive the granular substance comprises a detachable hopper.

11. A system for launching a granular substance, the system comprising:

an air gun comprising a barrel configure'd to discharge discrete pulses of compressed air from the barrel;

an apparatus for launching a granular substance comprising:

an insertion tube configured to insert into an open end of a barrel of an air gun;

a continuous passage coupled to the insertion tube, the passage and the insertion tube forming a contiguous passageway, the contiguous passageway having a substantially consistent diameter, the passageway configured to channel air discharged from the barrel of the air gun;

a loading chamber disposed within the passage, the loading chamber configured to contain and temporarily store an amount of a granular substance during a time period between discharges of air from the air gun, the base of the loading chamber formed from a declivity of the passage;

a recess connected to the loading chamber and located externally to the passage, the recess configured to receive the granular substance, temporarily store the granular substance by allowing the granular substance to rest on walls of the recess and on the granular substance in the loading chamber, and dispense the granular substance into the loading chamber after a discharge of air from the air gun;

a top of the recess remaining substantially level with a top of the barrel of the air gun; and a fastening assembly configured to conjoin the apparatus to the barrel of the air gun.

12. The system of claim 11, wherein the loading chamber formed from the declivity of the passage is formed such that an approximately consistent portion of the granular substance is dispensed into the declivity, rests upon a floor of the declivity, and is confined within the declivity until the passage receives a discharge of air from the air gun, the declivity comprising a bow shape.

13. The system of claim 11, wherein a hopper is contained within the recess, wherein the granular substance enters the hopper and rests upon walls of the hopper, the walls of the recess, and on the granular substance in the loading chamber, until the passage receives an air discharge from the air gun.

14. The system of claim 11, wherein the recess connected to the loading chamber comprises a pure gravity feed.

15. The system of claim 11, wherein the insertion tube comprises a plurality of interchangeable insertion tubes, each interchangeable insertion tube corresponding to a specific caliber of the bore of the barrel of the air gun.

16. The system of claim 11, wherein the insertion tube may screw into the apparatus.

17. The system of claim 11, wherein the fastening assembly comprises a fastener attached to the apparatus, a fastener attached to the air gun, and an elastic band mechanically attached to both fasteners such that the apparatus and air gun are coupled together.

18. The system of claim 17, wherein the fastener attached to the air gun comprises a mechanical feature of the air gun suitable for attachment of the elastic band.

19. The system of claim 17, wherein the fastener attached to the air gun comprises a mechanical feature anchored to the air gun suitable for the attachment of the elastic band.

* * * * *